US009746274B1

(12) United States Patent
Bhattacharya

(10) Patent No.: US 9,746,274 B1
(45) Date of Patent: Aug. 29, 2017

(54) PROJECTILE FIRING APPARATUS

(71) Applicant: Utpal Bhattacharya, Condell Park (AU)

(72) Inventor: Utpal Bhattacharya, Condell Park (AU)

( * ) Notice: Subject to any disclaimer, the term of this patent is extended or adjusted under 35 U.S.C. 154(b) by 0 days.

(21) Appl. No.: 15/352,766

(22) Filed: Nov. 16, 2016

(30) Foreign Application Priority Data

Feb. 18, 2016 (AU) ..... 2016900568
Mar. 3, 2016 (AU) ..... 2016100226

(51) Int. Cl.
*F41B 3/04* (2006.01)

(52) U.S. Cl.
CPC ..... *F41B 3/04* (2013.01)

(58) Field of Classification Search
CPC ..... F41B 3/04
See application file for complete search history.

(56) References Cited

U.S. PATENT DOCUMENTS 1,408,137 A * 2/1922 Parsons ..... F41B 3/04 124/6
1,783,053 A * 11/1930 Baden-Powell ..... F41B 3/04 124/6
2,566,090 A 8/1951 Marcy
2,684,062 A * 7/1954 Rose ..... A62C 99/009 124/6
4,632,086 A * 12/1986 Rutten ..... F41B 3/04 124/4
5,857,451 A 1/1999 Ciluffo et al.
7,806,788 B1 10/2010 Neuman

FOREIGN PATENT DOCUMENTS

GB 191420363 0/1915
GB 436324 10/1935
WO 03/000345 1/2003

* cited by examiner

*Primary Examiner* — John Ricci
(74) *Attorney, Agent, or Firm* — Sand & Sebolt

(57) ABSTRACT

An apparatus for firing projectiles including a feeding mechanism adapted to feed projectiles into rotating arms rotating around an axis within a guide wall. The wall includes an opening through which the projectile are expelled due to the rotation of the arms. Strikers attached to each arm are so positioned so that they strike the projectile that has been expelled through the guide accelerating the projectile.

4 Claims, 3 Drawing Sheets

PROJECTILE FIRING APPARATUS

FIELD OF THE INVENTION

The present invention relates to an apparatus to fire projectiles using centrifugal force. In particular once ejected from a swinging arm a projectile receives further momentum by virtue of a striker that strikers the projectile to provide it with additional velocity before it fired from the apparatus

BACKGROUND TO THE INVENTION

Centrifugal machines have been around us in various forms for more than a hundred years (in fields of weapons, engineering and sports). These machines utilise the centrifugal force developed by arms swung around an axis. The American Civil War saw the use of a steam driven centrifugal gun. In the early part of the twentieth century patents were filed for vehicle mounted and fixed centrifugal guns. Centrifugally operated sports ball throwers and clay pigeon launchers are quite well known. All these machines and devices have a common feature where the swing arm lengths and the speed of rotation are used to achieve the desired final launched momentum of the projectiles. The size of these mechanical setups is large and makes them unwieldy. The centrifugal machines never did dominate or replace the gun powder or chemical propellant based technology. Despite the inherent danger in handling the chemical based technologies and the investment requirement in manufacturing the propellants, the compactness of the chemical based weapon systems have made them convenient to carry, transport and use in fast moving battle conditions.

The present invention here concerns a momentum boosting mechanism with the ability to transfer additional momentum to projectiles while in flight after being launched from a centrifugal machine or device.

SUMMARY OF THE INVENTION

In a first aspect of the invention there is proposed an apparatus for firing projectiles including:

a feeding mechanism adapted to feed a projectile into a rotating arm rotating around an axis within a guide wall, the wall having at least one opening through which the projectile is expelled due to the rotation of the arm;

a striker attached to the rotating arm at a further distance from the axis than the end of the arm and positioned so that it strikes the projectile that has been expelled through the guide wall imparting momentum to the projectile and causing it to travel at a greater velocity.

In preference the apparatus is located within a gun, the accelerated projectile fired through the gun nozzle.

In preference the apparatus includes a plurality of arms, each arm having associated with it a separate striker.

It should be noted that any one of the aspects mentioned above may include any of the features of any of the other aspects mentioned above and may include any of the features of any of the embodiments described below as appropriate.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

LIST OF COMPONENTS

Figure 1:
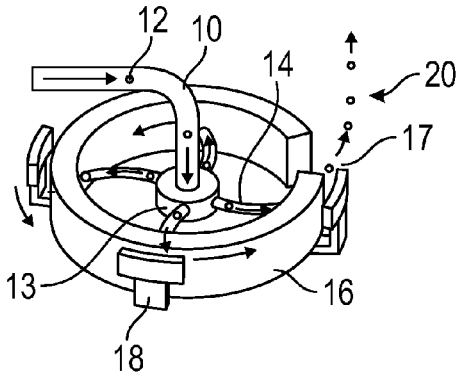
FIG. 1 is a perspective view illustrating the mechanism for imparting momentum transfer to an object.

10 feeder tube
12 projectile
13 feeder chamber
14 swinging arms
16 guide wall
17 opening in guide wall
18 striker
20 fired projectiles
22 gun
24 funnel shaper collector
26 battery
28 magazine
30 ball
32 motor

DETAILED DESCRIPTION OF THE INVENTION

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Figure 2:
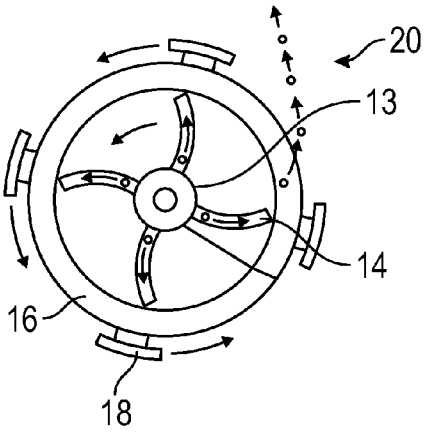
FIG. 2 is a top view of the mechanism of FIG. 1.

FIGS. 1 and 2 illustrate the operation of the present invention. a feeder tube feeds projectiles 12 into a feeder chamber 13 that is rotated and due to centrifugal force a projectile is fed and into one of plurality of hollow swinging arms 14 that are rotated at a predetermined velocity. Once inside the hollow swing arm the projectile slides on the smooth interiors of the swing arm in an outwardly direction. This movement is due to the ever increasing centrifugal force proportional to the distance from the centre of the feeder chamber. The projectile reaches the outer most possible position within the hollow swing arm and is either stopped by guide plate or wall 16 present along the circumference or gets launched in a tangential direction guide wall initially, slide along the inner surface it to reach an opening 17 in the wall and out into open space. Here it is launched in a tangential direction from its point of separation with the swing arm. As the width of the open space in the guide wall is deliberately chosen and positioned, this limits the points of launch of the projectiles to a small region. This gives control on the general direction of launch and the spread of the launch area.

After the launch of the projectile, it travels at a speed which is close to the maximum speed achieved by it just before separating from the outer end of the swing arm. At this second stage of propulsion of the projectile, the momentum booster mechanism comes into action. Strikers or hammers 18 are fixedly attached in relation to each swing arm 14 at a position calculated so it causes to meet the flying projectile at a pre-destined point in its flight path. The striker 18 carries substantial angular momentum due to the mass of the rotating body it is firmly attached to and has a higher angular velocity due to its greater distance from the centre as compared to the length of the swing arm. The momentary contact of the fast moving striker with the comparatively slower projectile results in transfer of additional momentum from the striker to the projectile. This increase in the momentum of the projectile causes it to travel or effectively be fired at a higher speed. The momentum booster works at all rotational speeds and does not need further positional adjustment from its original position. Each set-up needs to be designed and built for one particular fixed shape of projectiles with a fixed singular set of dimensions, weight and density. The angular velocity of the centrifugal body affects the momentum generated by it, in turn this leads to the variation of the initial velocity of the projectile as well as the subsequent quantity of additional momentum transferred to it by the striker. The striker plays an important role in controlling the flight paths, momentums and induced spins in the propelled projectiles. The various shapes, sizes, mass of the strikers and the alignments and curvatures of the striking faces can influence the flight characteristics of the projectiles like the spin, velocity, range and the flight path. The striker is fixed on to the platform that the swinging hollow arm of the centrifugal machine is fixed on as well. This platform could vary in shape size and be of any convenient dimensions as long as it carries out its function of providing a stable base for the required components of the machine to be attached to. The platform is well balanced mechanically and the axis of rotation passes perpendicularly through its centre.

Figure 3:
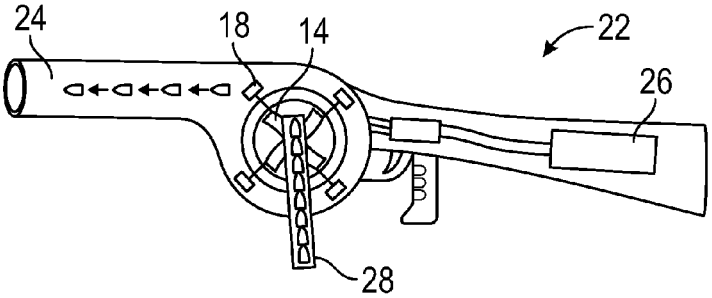
FIG. 3 illustrates the application of the present invention to a gun.
Figure 12:
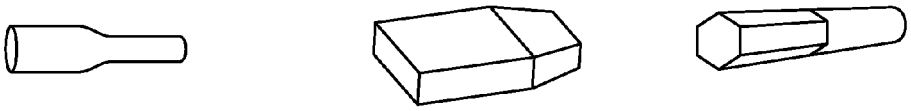
FIG. 12 illustrates various possible configurations of the funnel from which the projectiles are ejected.

FIG. 3 illustrates a gun 22 utilising the present invention. The momentum boosted centrifugal machine can achieve remarkable performance with a much shorter swing arm length at much slower rotational speeds and low applied torque in comparison to a standard or simple centrifugal machine of similar dimensions. The momentum boosted projectile flies in the direction of a funnel shaped collector 22. The rotation of the swing arms 14 and the strikers 18 is powered by battery 26 that drivers a motor (not shown) and gets discharged from a narrow nozzle end resulting in a potential flight path zone with a small cross sectional area. The shape of the funnel can be varied from a conical to squarish to multi-faced shapes. FIG. 12 illustrates possible shapes the shapes of funnel collector 24.

Figure 4:
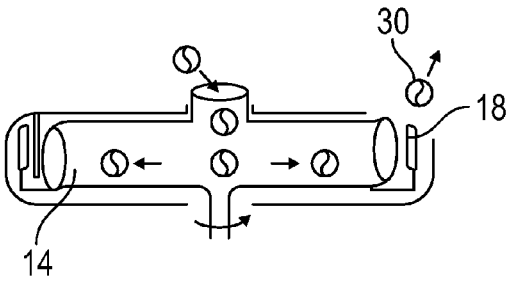
FIG. 4 illustrates in a side view the application of the present invention in relation to a ball thrower.
Figure 5:
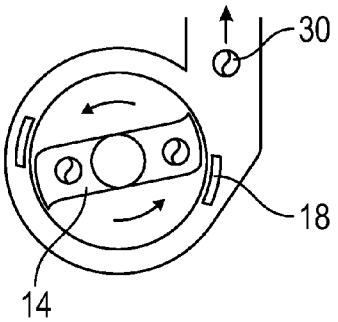
FIG. 5 is a top view of the ball thrower of FIG. 4.

The present invention also has applications to various industries besides firing projectiles. Thus as shown in FIGS. 4 and 5 it can be used to launch sporting balls such as tennis or baseball balls 30.

Figure 6:
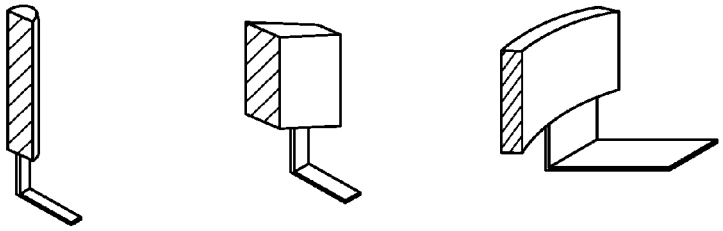
FIG. 6 represents the various shapes and configurations of a striker.
Figure 7:
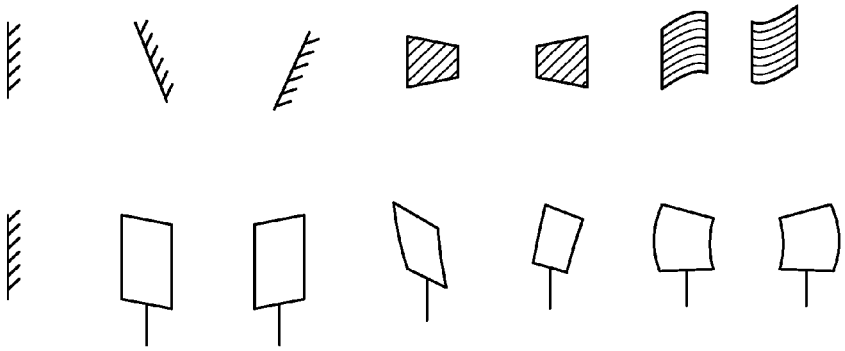
FIG. 7 illustrates various facial orientations of the striking face of the striker.

FIG. 6 shows the possible types of strikers capable of being used in the present invention. Whilst FIG. 7 shows various facial orientations of the striking face of the striker that can be used to impart different types of spin in each projectile.

Figure 8:
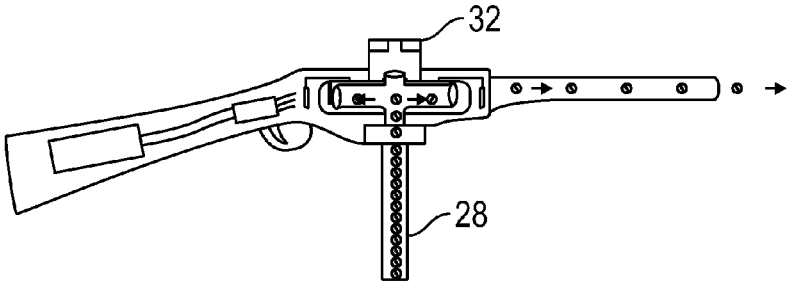
FIG. 8 is a side view of a gun employed to fire rubber bullets.
Figure 9:
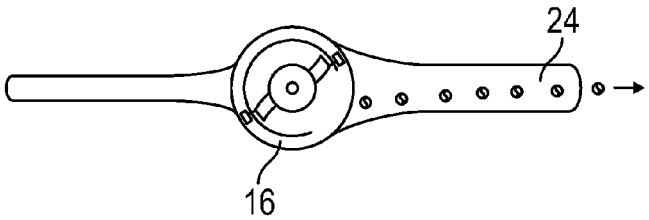
FIG. 9 is a top view of the gun in FIG. 8.

Illustrated in FIGS. 8 and 9 is a schematic diagram of gun to fire rubber bullets for riot control or target shooting sports applications. A motor 32 is used to spin the arms and the strikers.

Figure 10:
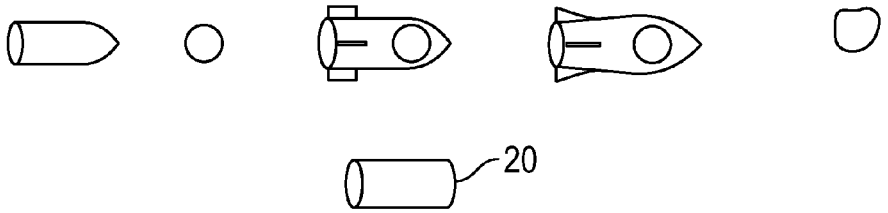
FIG. 10 illustrates various shapes of projectiles that can be fired using the present invention.

The shapes of the projectiles capable of being propelled by momentum boosted centrifugal machine are featured in FIG. 10.

Figure 11:
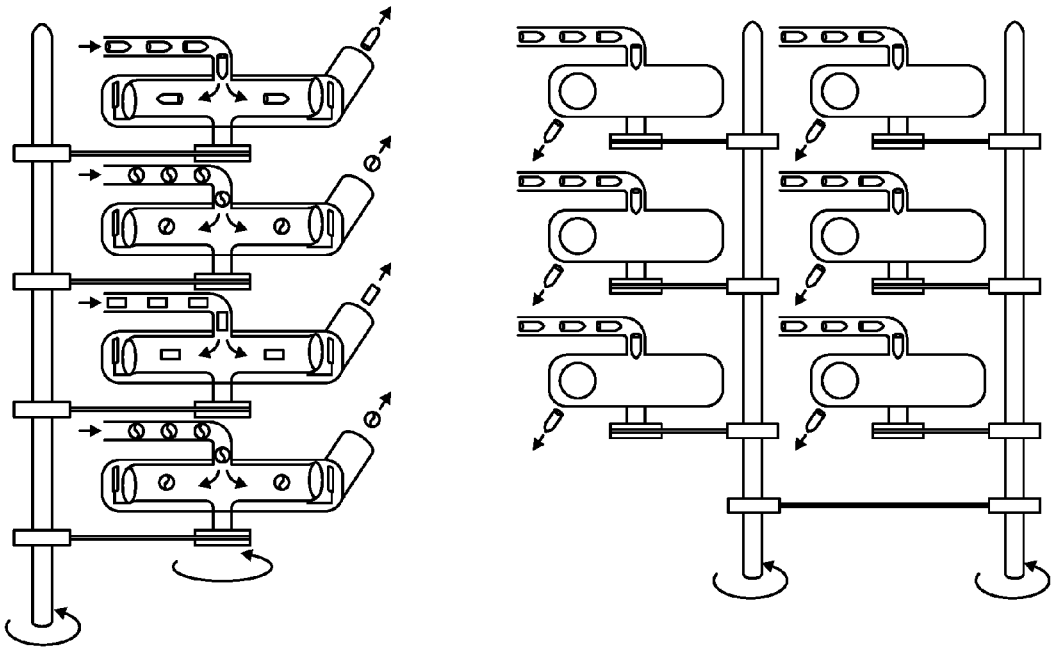
FIG. 11 illustrates the present invention when used in a multi-configuration arrangement.

Multi stacked units for application in defensive systems against missile and rocket propelled grenade attacks on naval vessels, fixed defence installations, mobile armoured carriers and military helicopters and planes are shown in FIG. 11.

The compact size and low torque requirement allows the machine to be portable and be able to be driven by high efficiency compact DC electric motors or other portable torque generators powered by batteries and other energy sources. The individual momentum boosted centrifugal machines can be stacked in columns and arranged in rows to create a wall of rapid shooting weapon systems that can shoot a continuous wall of flying projectiles. Such a weapon system can be effective as a medium and short range defensive measure against missile and rocket propelled grenade attacks.

The reader will now appreciate the present invention which basically has two parts to it. One is the presence of a guide wall outside the circumference of the path of an outer edge of the hollow swing arm of the centrifuge. The guide wall includes an open portion in its circumference to allow the projectiles to be launched. The second part concerns the transfer of free available momentum from the rotating platform (to which the swing arms are attached) to the launched projectile while in its flight. This makes the entire task of propelling projectiles more efficient as the ready available rotational energy from the rotating centrifugal part of the setup is exploited to generate additional momentum in the projectile. This mechanism is suitable for the centrifugal plane placed in any conceivable angle or position where the motion and activity of the setup is not obstructed. Different configurations of the striker component of the apparatus can be used to achieve modified flight paths, curves or speeds of the projectiles. This mechanism has the ability to effect boosted momentum propulsion in spherical shaped, streamlined spherical (tear drop) shaped, a generic bullet shaped, blunt cylindrical shaped projectile. This invention can be used in portable and fixed devices and machines and driven by DC or AC electric motors powered by batteries and various power sources, driven by internal combustion engines, human powered devices, wind powered or any other source that generates sufficient mechanical torque. The applications of the invention in sports ball throwing machines, soft and hard projectile shooting portable and fixed guns for defence and sports related purposes, other any feasible engineering applications and for defence or military related applications is described and portrayed in this document.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the present specification and claims (if any), the word "comprising" and its derivatives including "comprises" and "comprise" include each of the stated integers but does not exclude the inclusion of one or more further integers.

The invention claimed is:

1. An apparatus for firing projectiles including:

a feeding mechanism adapted to feed a projectile into a rotating arm rotating around an axis within a guide wall, the wall having at least one opening through which the projectile is expelled due to the rotation of the arm in a first direction;

a striker attached to the rotating arm at a further distance from the axis than the end of the arm and positioned so that it strikes the projectile that has been expelled through the guide wall imparting momentum to the projectile and causing it to travel at a greater velocity and in a second direction.

2. An apparatus as in claim 1 wherein it is located within a gun, the accelerated projectile fired through the gun nozzle.

3. An apparatus as in claim 1 including a plurality of arms, each arm having associated with it a separate striker.

4. An apparatus as in claim 1 wherein the striker includes a face adapted to impart spin to the projectile.

* * * * *